United States Patent [19]

McCaslin

[11] 4,282,681

[45] Aug. 11, 1981

[54] ELECTRONIC WAND

[76] Inventor: Robert E. McCaslin, 1227 Coldwater Canyon, Beverly Hills, Calif. 90210

[21] Appl. No.: 99,186

[22] Filed: Nov. 30, 1979

[51] Int. Cl.[3] ..... A63H 33/26

[52] U.S. Cl. ..... 46/228; 46/227; 200/DIG. 2; 340/331; 84/477 B; 307/116

[58] Field of Search ..... 46/229, 228, 227, 226, 46/232; 200/DIG. 1, DIG. 2; 307/157, 116; 362/295, 802; 340/321, 331; 272/8 N, 8 R; 84/477 B; 324/62

[56] References Cited

U.S. PATENT DOCUMENTS

| | | | |
|---|---|---|---|
| 2,108,802 | 2/1938 | Dorsey | 84/477 B UX |
| 3,394,491 | 7/1968 | Valentine | 46/232 X |
| 3,553,572 | 1/1977 | Harmon | 324/62 X |
| 3,689,832 | 9/1972 | Leto et al. | 340/384 E |
| 3,707,055 | 12/1972 | Pearce | 46/228 |
| 3,737,722 | 6/1973 | Scharlack | 315/209 R |
| 4,119,864 | 10/1978 | Petrizio | 307/116 |

OTHER PUBLICATIONS

Pushbutton Switch With No Moving Parts, R. A. Johnson, IBM Technical Disclosure Bulletin, vol. 13, No. 11, Apr. 1971.

*Primary Examiner*—Gene Mancene
*Assistant Examiner*—Mickey Yu
*Attorney, Agent, or Firm*—John L. McGannon

[57] ABSTRACT

A wand adapted to be held in the hand and provided with a rod-like body provided with a handle having a base at one end and a visual indicator at the opposite end. The base defines a handle for grasping the wand and the base is hollow to house an electronic circuit and a battery for operating the circuit. The circuit is a multivibrator whose output signal oscillates at a given frequency, such as 120 Hz. The visual indicator is coupled with the circuit and is caused to flash at the operating frequency of the circuit when the circuit operates. The base has a pair of spaced terminals thereon which are bridged by the palm of the hand when the base is grasped, and the palm therefore provides a resistance forming part of the circuit to cause the frequency of flashing of the visual indicator to change depending upon the extent to which hand pressure is applied to the base. For increased frequency, greater hand pressure is applied to decrease the resistance accordingly. Conversely, by decreasing the hand pressure the frequency will decrease.

1 Claim, 5 Drawing Figures

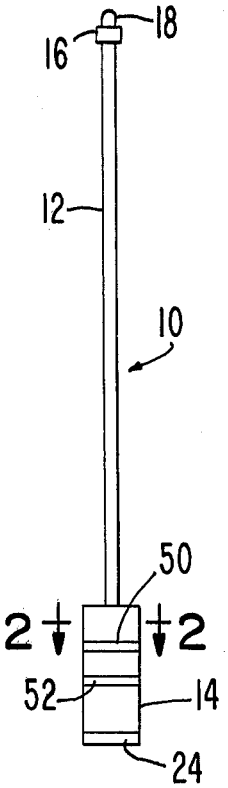
FIG. 1
FIG. 2
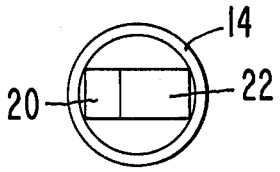
FIG. 3
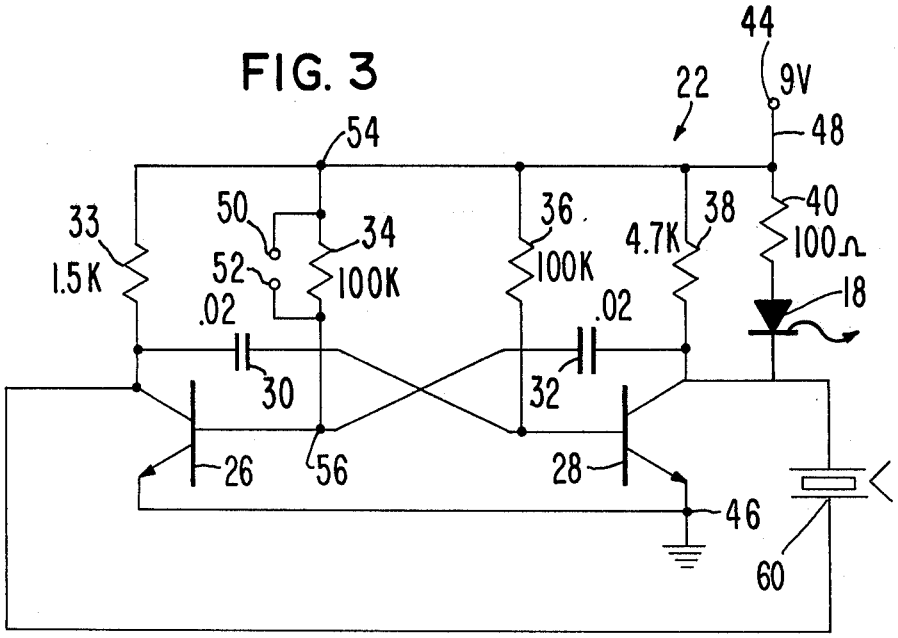

ELECTRONIC WAND

This invention relates to improvements in electronic toys and games and, more particularly, to a wand or baton which has a visual indicator capable of flashing as the wand is manipulated by the user.

BACKGROUND OF THE INVENTION

Wands or batons have been made and used for amusement or as toys in the past. Some have been provided with visual indicators by electrical means but these have not been sophisticated sufficiently to provide flickering or flashing visual indicators whose flashing rate can be changed at the will of the user. Since electronic wands or batons of this type provide enjoyment for many people, especially young children, and in view of the present state of the art in this field in which there has hardly been any development, a need has arisen for an improved electronic wand or baton which has a flashing visual indicator whose flashing rate can be readily changed as the wand is whirled or moved about by the user.

SUMMARY OF THE INVENTION

The present invention satisfies the aforesaid need by providing a wand which is hand-held and has a flexible body provided with a handle at one end and a visual flashing indicator at the opposite end, the handle being provided with electronic circuitry for operating the visual indicator. The handle is further provided with means for permitting the palm of the hand to be part of the electronic circuitry so that, by exerting more or less pressure by the hand on the handle itself, the flashing rate of the visual indicator can be changed. All of the foregoing contributes to the enjoyment of the use of the wand and stimulates the interest in the user to generate new visual designs merely by twirling or moving the wand. During the movement of the wand, the user can exert greater or lesser hand pressure on the handle to provide a greater or lesser frequency of operation of the flashing visual indicator. In this way many different light designs can be formed much to the enjoyment and amusement of those watching the movements of the visual indicator on the wand.

The primary object of this invention is to provide an improved electronic wand which has a visual indicator which can be moved about and caused to flash at varying frequencies to thereby provide visual light patterns of aesthetic quality and to stimulate the interest in the user of the wand to create new and unique patterns of light by selectively moving the wand about and by causing a change in the frequency of flashing of the visual indicator is changed.

Another object of this invention is to provide an electronic wand of the type described wherein the frequency of flashing of the visual indicator can be changed by applying a greater amount or a lesser amount of pressure by the hand on the handle of the wand to thereby permit the user to control the shapes and designs of the light patterns produced by the combined movements of the wand and the flashing of the indicator.

Other objects of this invention will become apparent as the following specification progresses, reference being had to the accompanying drawing for an illustration of the invention.

IN THE DRAWING

FIG. 1 is a side elevational view of the electronic wand of the present invention;

FIG. 2 is a cross-sectional view taken along line 2—2 of FIG. 1;

FIG. 3 is a schematic view of the multivibrator used with the wand of FIG. 1 and, FIGS. 4 and 5 are schematic views of circuits for use with the wand of the present invention, the circuits being operable to produce both sound and light indications for the wand.

Figure 4:
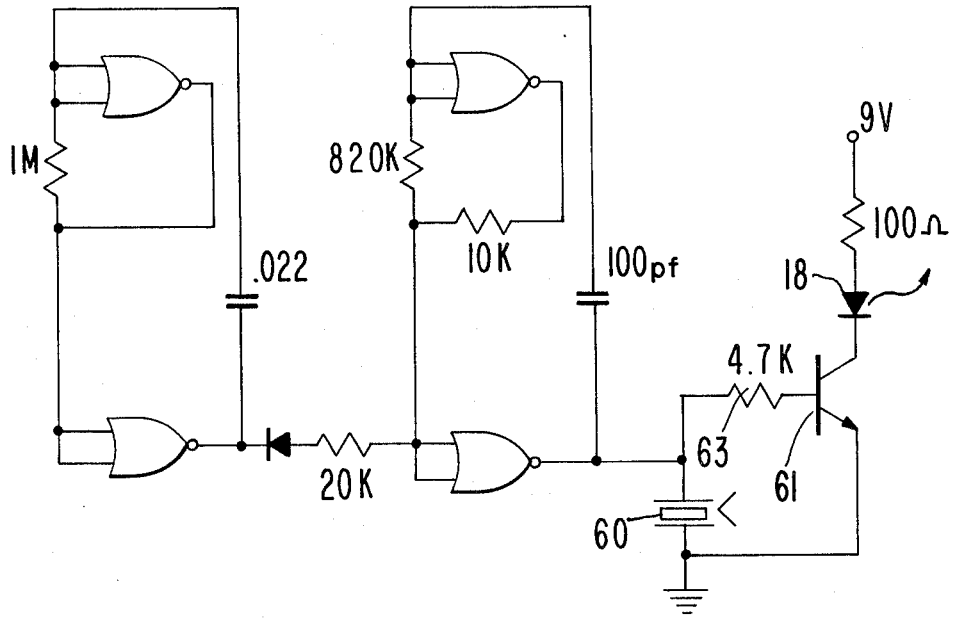

The electronic wand of the present invention is broadly denoted by the numeral 10 and is illustrated in FIGS. 1 and 2. Wand 10 includes a rod-like body 12 having a base 14 at one end thereof and a mount 16 for mounting a visual indicator, such as a light emitting diode 18, at the opposite end of the body. Body 12 typically is 24 to 36 inches in length and is preferably flexible so that it can be whipped around when a person holding base 14 twirls the wand in a circular fashion or waves it about in any other manner. A typical material for body 12 is plastic although it can be of metal or even wood.

Base 14 defines essentially a handle which is grasped by the user of the wand. To this end, the base is of a diameter or other shape which can fit conveniently in the hand and the body will have a length suitable for this purpose as well. Base 14 is hollow and is provided with a battery 20 and circuitry 22 for operating the visual indicator 18. Electrical leads (not shown) extend through body 12 and interconnect the indicator and the circuitry.

FIG. 2 illustrates in block form the relative positions of the battery and circuitry within the handle. Any suitable means can be provided for removably mounting the battery and the circuitry in base 14 but preferably they are mounted so that they can be quickly and easily removed from base 14, if desired. Typically, base 14 has an open lower end which is removably covered by a cap 24 threaded onto the end of the base.

Circuitry 22 defines a multivibrator of conventional design. Typically, the multivibrator is comprised of a pair of transistors 26 and 28, a pair of capacitors 30 and 32, resistors 33, 34, 36, 38 and 40, and light emitting diode 18, all the foregoing components being coupled in the manner shown in FIG. 3 to form the multivibrator. The battery terminals are connected to points 44 and 46 as is well known. A suitable on/off switch 48 can be provided to enable circuitry 22 to cause indicator or diode 18 to flash in accordance with the frequency of operation of the multivibrator.

Resistor 34 is provided with a pair of terminals 50 and 52 at the opposite ends thereof, these terminals being in the form of electrically conducting bands and surrounding base 14 and spaced apart as shown in FIG. 1. The purpose of terminals 50 and 52 is to permit the effective resistance between points 54 and 56 of circuitry 22 to change by putting the resistance of the hand in parallel with resistor 34. When the hand of the user grasps base 14, the hand acts as a resistor in parallel with resistor 34. By applying greater or lesser hand pressure to base 14, the resistance decreases or increases proportionately. Decreasing the resistance has the effect of increasing the frequency of operation of the multivibrator and thereby of the flashing of the visual indicator 18. As the grip of the hand on base 14 tightens on the base, this resistance further decreases, thereby further increasing the frequency. Conversely, a light pressure of the hand on base 14 decreases the frequency.

In use, the person using the wand grips base 14 and then turns on the switch to actuate the multivibrator circuitry 22. Visual indicator 18 commences to flash and, when the wand is rotated in a circular or moved about in any other fashion, the light from the indicator defines a streak which can be symmetrical or irregular in shape depending upon the motion of the wand as twirled or moved about. The frequency of operation typically of the multivibrator is 120 Hz; however, this frequency can be caused to increase by tightening the grip on base 14 to further reduce the resistance in parallel with resistor 34. By virtue of this provision, a person can provide many different visual displays and stimulate the interest and enjoyment of others viewing the movement of the visual indicator.

Sound effects can be used with the wand along with visual indicator 18. To provide sound effects, a piezoelectric transducer 60 can be coupled between the collector of transistor 28 and the collector of transistor 26 as shown in FIG. 3. Transducer 60 produces buzzing sounds and the circuit of FIG. 3 with transducer 60 in it works in a push-pull fashion, giving an 18 volt peak-to-peak signal to the transducer. The sound heard is at the same frequency of the flashing of the light so that the sound changes frequency by the change of hand pressure.

A second method of producing both sound and light indications can be done by using a quad-two input NOR gate circuit of the type shown in FIG. 4. In this circuit, indicator or diode 18 is coupled to the collector of the transistor and the piezoelectric transducer 60 is coupled with the base of the transistor 61 through a resistor 63.

Figure 5:
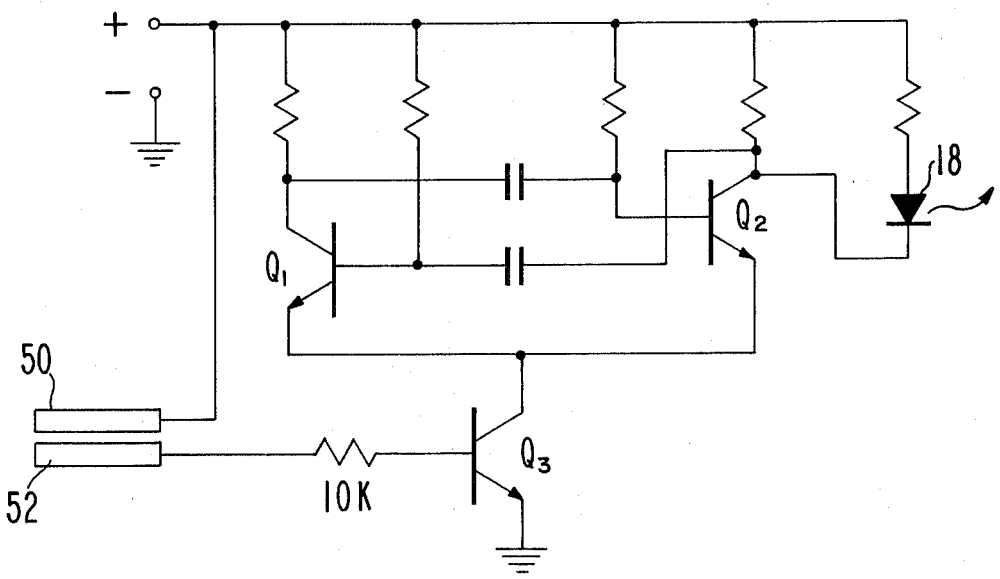

A third method for accomplishing both light and sound indications with the wand includes the use of the circuit of FIG. 5. In this method, the wand is actuated when it is picked up. The conductive strips 50 and 52 mounted on the handle are used as an on/off switch. The body resistance is enough to bias the q-3 transistor to an on condition, activating the electronics of the remainder of the circuitry. When the wand is put down and released from hand pressure, the circuitry is turned off automatically.

I claim:

1. An electronic wand adapted to be held in the hand comprising: a rod-like body provided with a hollow base at one end thereof and a light emitting diode at the opposite end thereof, said base defining a handle capable of being grasped by the hand; and an electronic circuit in said base and electrically coupled with said light emitting diode, said circuit including a multivibrator having an output signal capable of oscillating at operating frequency to cause the light emitting diode to flash, said base having a pair of spaced terminals thereon coupled to the circuit, said terminals being bridged by the palm of the hand when the handle is grasped so that the palm provides a resistance forming part of the circuit, said resistance being variable as a function of hand pressure to cause a change in the frequency of flashing of the light emitting diode.

* * * * *